United States Patent [19]

Scrivens

[11] Patent Number: 4,631,756

[45] Date of Patent: Dec. 30, 1986

[54] METHOD OF MAKING APPAREL

[75] Inventor: George W. Scrivens, Arlington, Tex.

[73] Assignee: Surgikos Inc., Arlington, Tex.

[21] Appl. No.: 700,576

[22] Filed: Feb. 11, 1985

[51] Int. Cl.[4] ..... A41D 27/10

[52] U.S. Cl. ..... 2/243 R; 2/114; 2/DIG. 7; 2/125

[58] Field of Search ..... 2/243 R, 114, 115, 125, 2/69, 243 B, DIG. 7

[56] References Cited

U.S. PATENT DOCUMENTS

| | | | |
|---|---|---|---|
| 3,451,062 | 6/1969 | Bradley | 2/114 |
| 3,720,957 | 3/1973 | Patience | 2/DIG. 7 X |
| 3,745,587 | 7/1973 | Bradley | 2/DIG. 7 X |
| 3,911,499 | 10/1975 | Benevento | 2/DIG. 7 X |
| 4,017,909 | 4/1977 | Brandriff | 2/114 |
| 4,523,336 | 6/1985 | Truman | 2/114 X |

*Primary Examiner*—Werner H. Schroeder
*Assistant Examiner*—J. L. Olds
*Attorney, Agent, or Firm*—Michael Q. Tatlow

[57] ABSTRACT

A method of forming and attaching sleeves to a garment, particularly an isolation gown is disclosed. The garment is constructed from a generally rectangular body portion and two sleeve portions. The body portion is cut and folded to form a straight line on each side and the sleeve portions are attached to the body on the straight line and then folded. The sleeve edges are then joined together to form the garment.

1 Claim, 6 Drawing Figures

FIG-1
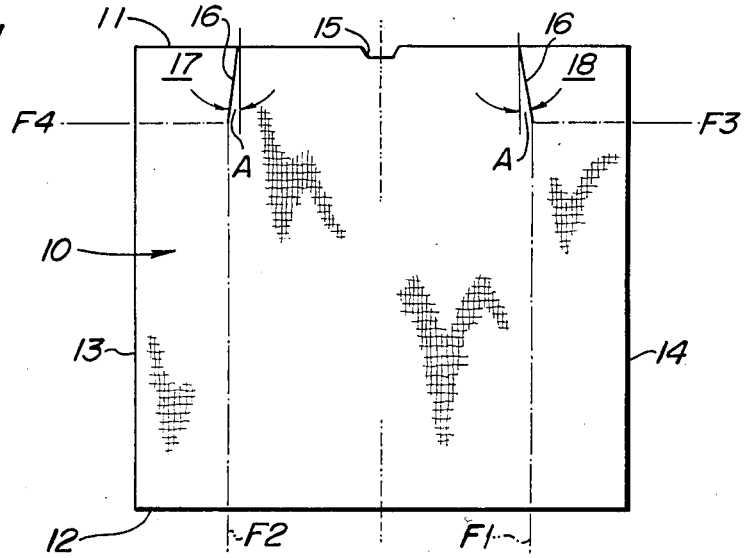
FIG-2
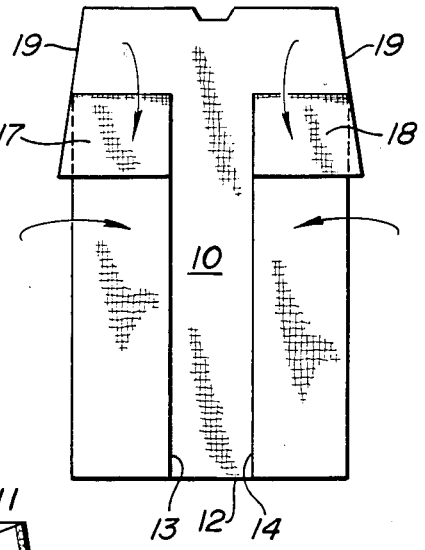
FIG-3
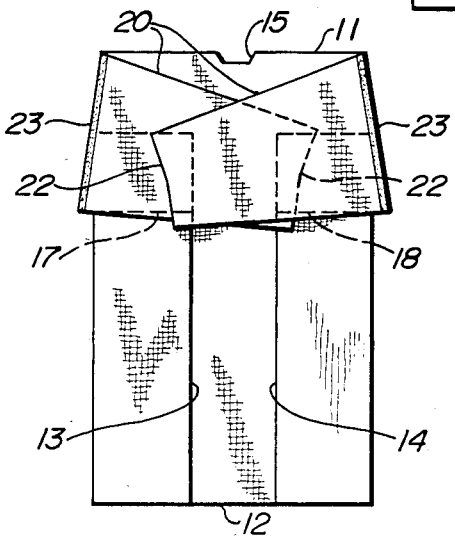
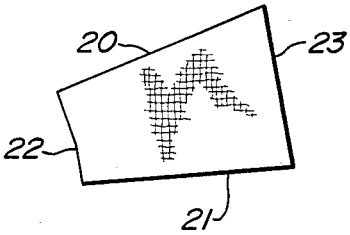
FIG-4

METHOD OF MAKING APPAREL

The present invention relates to an improved method for the manufacture of low-cost apparel and, in particular, to a method of attaching sleeves to garments. The invention is particularly useful in the manufacture of isolation gowns and other disposable medical apparel.

PRIOR ART

Background of the Invention

Although the method of the present invention may be used in the attachment of sleeves to any type of garment, such as shirts, dresses, jackets, etc., the method is particularly useful in the manufacture of inexpensive medical gowns such as examination or isolation gowns. Inexpensive examination or isolation gowns are commonly used in hospitals, sick rooms and in various diagnostic facilities. The gowns are used by members of the medical staff as well as visitors to isolated patients and are used as examination gowns. The gowns are generally made of a low-cost, nonwoven fabric so that they may be readily disposed of after use. Isolation gowns are worn to isolate a visitor or hospital staff worker from a patient who may have a communicable disease or whose condition is such that it is desirable to avoid the possibility of communicating diseases to the patient.

The majority of prior art disposable examination gowns did not provide adequate cover for the patient. Most of these gowns did not have sleeves and, although they could be used as examination gowns, could not be used as isolation gowns because of the lack of sleeves. Sleeves are difficult to apply to relatively inexpensive gowns because of the complexity of attaching the sleeves to the body of the garment.

U.S. Pat. Nos. 3,451,062 and 3,745,587 show various examination tion gowns which are made of single pieces of inexpensive fabric and which cover the body of the patient but do not cover the arms of the patient. U.S. Pat. Nos. Des. 233,645 and 236,239 show additional designs of gowns which have integral sleeves. Italian Pat. No. 585,109 and Swiss Pat. No. 44,675 also show various gown constructions where the sleeves are formed integrally with the body of the garment.

U.S. Pat. No. 3,911,499 discloses a disposable medical gown which has been cut from a single piece of material and which has integral sleeves.

The above-mentioned sleeveless gown designs are not suitable for use as isolation gowns. The gowns with the integral sleeves are too complicated and require too much labor to provide inexpensive, adequately-fitting disposable medical gowns.

The present invention overcomes the problems mentioned above and provides a simple method of attaching sleeves to medical gowns. The method is particularly adaptable to automation as the sleeves are sewn to the gowns along straight lines.

BRIEF DESCRIPTION OF THE DRAWINGS

FIG. 1 shows the cutting pattern for the body of the gown.

FIG. 2 shows the next step in the manufacture of the gown.

FIG. 3 shows the step following the step of FIG. 2.

FIG. 4 shows the pattern of the sleeves.

DETAILED DESCRIPTION OF THE INVENTION

The gowns of the present invention are generally made with a nonwoven material. Such nonwoven materials are well known in the art and are generally webs of rayon, polyester or polypropylene fibers which have been wet or dry laid and with the fibers in the web being secured together by a binder, the application of heat or pressure or by entanglement of the fibers using a fluid. Melt blown and spunbonded fabrics as well as laminates of such fabrics with cellulosic tissue or other materials may also be employed. The gown of the present invention is composed of three pieces, a generally rectangular body portion and two separate sleeve portions. The gown is assembled by securing the sleeve portions to the main body portion by sewing or by bonding with adhesives, or with heat, or radio frequency, or sonic energy. The selection of the particular method of bonding or affixing the sleeves to the body portion of the gown will depend on the fabric from which the gown is made.

Figure 5:
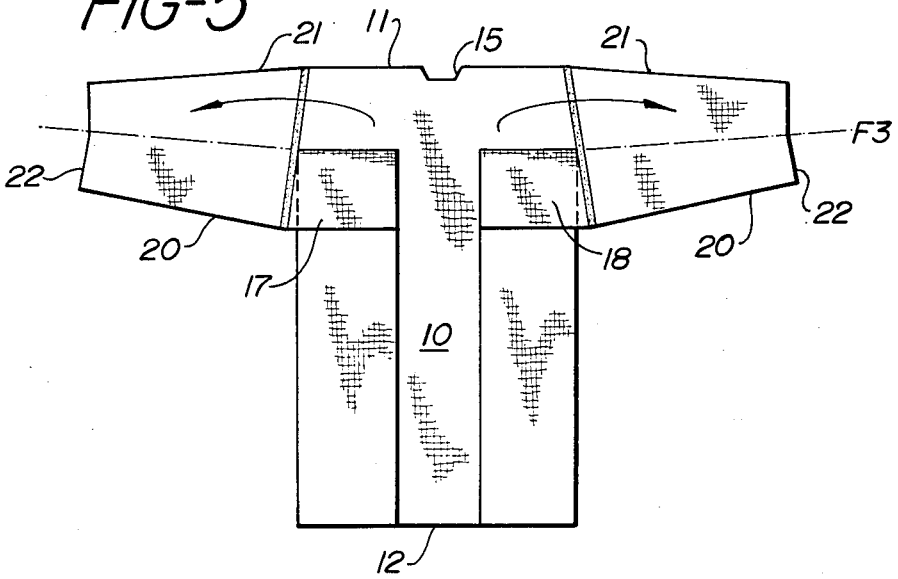
FIG. 5 shows the next step in the manufacture of the gown.
Figure 6:
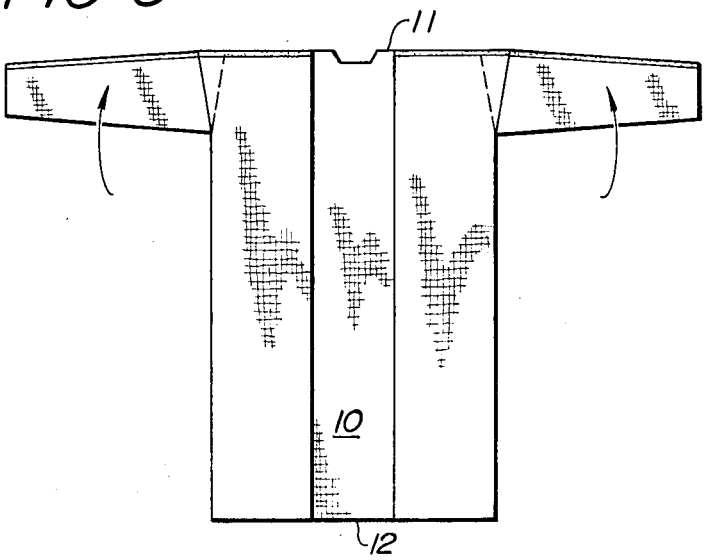
FIG. 6 shows the final step in the manufacture of the gown.

Referring now to FIG. 1, the gown comprises a body portion 10 which is a generally rectangular sheet of nonwoven fabric. The body portion has a top edge 11, a bottom edge 12 and two opposed side edges 13 and 14. A neck opening 15 can be cut out of the top edge of the main body portion to allow a better fit around the neck of the wearer. The first step in the manufacture of the gown is to cut the main body of the gown on each side of the longitudinal center line of the gown from a first point on the top edge of the body portion of the gown to a second point in the body portion of the gown. The first point is along the top edge of the gown and approximately one-half the distance between the longitudinal center line of the body portion of the gown and a side edge of the body portion of the gown. The cut is made at an angle "A" of from 15 degrees to 30 degrees to the line parallel to the longitudinal center line of the gown. The second point is in the body portion of the gown at a point where the lower edge of the attached completed sleeve will meet the body portion of the gown. The second point is approximately one-third the distance from the top edge to the bottom edge of the body portion for a waist length garment and one-sixth the distance from the top edge to the bottom edge of the body portion for a knee length garment. The side edges of the gown are then folded along fold lines F1 and F2. The fold lines F1 and F2 are parallel to the side edges and pass through the second point of the cut line. Flap portions 17 and 18 are formed by folding the upper portions of the gown around fold lines 3 and 4, which are parallel to the top edge of the gown and which also pass through the second point of the cut line, to form the gown pattern shown in FIG. 2. The folded side edges of the flaps form a straight line edge 19 with the unfolded upper portion of the main body portion of the gown. The sleeve portions of the gown can then be secured to the body portion. Each of the sleeve portions comprises a piece of fabric of the same type as the body of the gown, which is in the shape of a trapezium or a trapezoid. The sleeve portions shown in FIG. 4 have a top edge 20, a bottom edge 21 and two opposing side edges 22 and 23. As shown in the drawings, the angle of the edge 23 is identical to the angle formed in the edge 19 of the body portion of the gown by folding the gown to form the flaps as shown in FIG. 2. The next step in the manufacture of the gown is shown in FIG. 3. The sleeve portions are placed with the edge 23 of the sleeve against the edge 19 in the body portion of the gown. These edges are then secured together by suitable means. The next step in the formation of the gown is shown in FIG. 5. The sleeve portions which have been secured to the edge 19 of the main body portion of the gown are unfolded and are then folded along a line which extends through both of the sleeves and lies generally along the fold lines F3 and F4 in the body portion of the gown. The top edges of the sleeves and the top edges of the gown are then secured together. As indicated in FIG. 6, the seal line across the top of the gown is a substantially continuous line.

As all of the attachment lines attaching the sleeves to the body portion of the gown and enclosing the top edge of the gown are substantially continuous lines, the design of the present gown can be readily automated.

I claim:

1. A method of forming a sleeve on a garment comprising:

(a) providing a body portion of the garment comprising a generally rectangular piece of fabric having a top edge, a bottom edge and two opposing side edges;

(b) cutting the body portion on a cut line extending from a point on the top edge which is approximately one-half the distance between the longitudinal center line and a side edge at an angle from a line parallel to the longitudinal center line of from 15° to 30° to a second point which is at a location between one sixth and one-third the distance between the top edge and the bottom edge of the body portion of the garment;

(c) folding the body portion about a first line perpendicular to the top edge and passing through the second point;

(d) folding the body portion about a second line perpendicular to the side edges and passing through the second point to form a flap with an edge that forms a straight line with the cut line in the body portion of the garment;

(e) providing a sleeve portion of fabric, said sleeve portion having a top edge, a bottom edge and two opposing side edges of unequal length, affixing the longer of the side edges of said sleeve portion to the straight line formed on the body portion of the garment, folding the bottom edge of said sleeve and the attached flap to overlap the top edge of the sleeve and the body portion and joining the top edge and the bottom edge of the overlapped fabric together to form the sleeve on the garment.

* * * * *